US010753645B2

(12) United States Patent
Matsuda et al.

(10) Patent No.: US 10,753,645 B2
(45) Date of Patent: Aug. 25, 2020

(54) REFRIGERATION CYCLE APPARATUS

(71) Applicant: Mitsubishi Electric Corporation, Tokyo (JP)

(72) Inventors: Takuya Matsuda, Tokyo (JP); Kosuke Tanaka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 26 days.

(21) Appl. No.: 16/066,703

(22) PCT Filed: Feb. 10, 2016

(86) PCT No.: PCT/JP2016/053941

§ 371 (c)(1),
(2) Date: Jun. 28, 2018

(87) PCT Pub. No.: WO2017/138107

PCT Pub. Date: Aug. 17, 2017

(65) Prior Publication Data

US 2019/0011148 A1 Jan. 10, 2019

(51) Int. Cl.
*F24H 1/20* (2006.01)
*F25B 1/00* (2006.01)
(Continued)

(52) U.S. Cl.
CPC ..... *F24H 1/208* (2013.01); *F24H 1/00* (2013.01); *F25B 1/00* (2013.01); *F25B 13/00* (2013.01);
(Continued)

(58) Field of Classification Search
CPC . F24H 1/208; F24H 1/00; F24D 17/02; Y02B 30/12; F25B 13/00; F25B 30/02;
(Continued)

(56) References Cited

U.S. PATENT DOCUMENTS 4,409,958 A * 10/1983 Fillios ..... F24D 19/1051 122/14.1
4,918,938 A * 4/1990 De Forest ..... F24H 4/04 62/238.6
(Continued)

FOREIGN PATENT DOCUMENTS

CN 203771791 U 8/2014
JP 59-180226 A 10/1984
(Continued)

OTHER PUBLICATIONS

Extended European Search Report dated Jan. 7, 2019 issued in corresponding EP patent application No. 16889809.6.
(Continued)

*Primary Examiner* — Emmanuel E Duke
(74) *Attorney, Agent, or Firm* — Posz Law Group, PLC

(57) ABSTRACT

Provided is a refrigeration cycle apparatus configured to perform a heating operation and a simultaneous heating and hot-water supply operation. The refrigeration cycle apparatus is configured to execute an operation mode circulating refrigerant through, in order, a discharge outlet of a compressor, a first heat exchanger, an expansion device, a second heat exchanger provided to a water tank, and a suction inlet of the compressor, and causing the refrigerant flowing through the second heat exchanger to evaporate by heat generated by a heat source provided to the water tank.

5 Claims, 7 Drawing Sheets

(51) Int. Cl.

| | |
|---|---|
| ***F25B 47/02*** | (2006.01) |
| ***F24H 1/00*** | (2006.01) |
| ***F25B 30/02*** | (2006.01) |
| ***F25B 13/00*** | (2006.01) |

(52) U.S. Cl.
CPC ..... *F25B 30/02* (2013.01); *F25B 47/02* (2013.01); *F25B 2313/008* (2013.01); *F25B 2313/009* (2013.01); *F25B 2313/02334* (2013.01); *F25B 2313/02341* (2013.01); *F25B 2313/02344* (2013.01); *F25B 2313/02742* (2013.01); *F25B 2500/31* (2013.01); *F25B 2700/2106* (2013.01)

(58) Field of Classification Search
CPC ..... F25B 47/02; F25B 1/00; F25B 2313/008; F25B 2313/02344; F25B 2313/02341; F25B 2500/31; F25B 2313/02334; F25B 2313/02742; F25B 2313/009; F25B 2700/2106
See application file for complete search history.

(56) References Cited

U.S. PATENT DOCUMENTS

2005/0155359 A1* 7/2005 Shin ..... F25B 49/02 62/125
2012/0060521 A1* 3/2012 Roetker ..... F25B 30/02 62/79
2012/0060535 A1* 3/2012 Crosby ..... F25B 30/02 62/238.7
2013/0145786 A1 6/2013 Tamaki et al.
2013/0180274 A1* 7/2013 Tamaki ..... F25B 49/022 62/115
2013/0312443 A1 11/2013 Tamaki et al.
2014/0033750 A1 2/2014 Tanaka et al.
2015/0000324 A1* 1/2015 Luo ..... F24H 4/04 62/324.1
2015/0204577 A1* 7/2015 Son ..... F22B 1/16 122/14.1
2016/0116191 A1* 4/2016 Tamaki ..... F24H 9/2021 62/160

FOREIGN PATENT DOCUMENTS

| | | | |
|---|---|---|---|
| JP | H06-221717 | A | 8/1994 |
| JP | 10-089816 | A | 4/1998 |
| JP | 2003-314892 | A | 11/2003 |
| JP | 2007-232265 | A | 9/2007 |
| JP | 2014-231944 | A | 12/2014 |
| WO | 2012/111063 | A1 | 8/2012 |

OTHER PUBLICATIONS

International Search Report ("ISR") dated Apr. 26, 2016 issued in corresponding International patent application No. PCT/JP21016/053941 (with English translation).
Office Action dated May 28, 2019 issued in corresponding JP patent application No. 2017-566457 (and English translation).

* cited by examiner

REFRIGERATION CYCLE APPARATUS

CROSS REFERENCE TO RELATED APPLICATION

This application is a U.S. national stage application of PCT/JP2016/053941 filed on Feb. 10, 2016, the contents of which are incorporated herein by reference.

TECHNICAL FIELD

The present invention relates to a refrigeration cycle apparatus, which is configured to perform an air-conditioning operation for air-conditioning of an indoor space by using an indoor heat exchanger and a hot-water supply operation for heating of water in a water tank by using a water heat exchanger.

BACKGROUND ART

Hitherto, there has been known a refrigeration cycle apparatus including a heat source-side heat exchanger and an indoor heat exchanger and being configured to perform air-conditioning of an indoor space by using the indoor heat exchanger by supplying cooling energy or heating energy generated in the heat source-side heat exchanger to the indoor heat exchanger. Moreover, among such related-art refrigeration cycle apparatuses, there has also been proposed a refrigeration cycle apparatus further including a water tank and a water heat exchanger and being configured to perform an air-conditioning operation for air-conditioning of an indoor space by using the indoor heat exchanger and a hot-water supply operation for heating of water in the water tank by using the water heat exchanger by supplying the heating energy generated in the heat source-side heat exchanger to the water heat exchanger (see Patent Literature 1).

CITATION LIST

Patent Literature

Patent Literature 1: WO 2012/111063 A1

SUMMARY OF INVENTION

Technical Problem

In the related-art refrigeration cycle apparatus being capable of performing both the air-conditioning operation and the hot-water supply operation, the heat source-side heat exchanger serves as an evaporator during a heating operation for heating of an indoor space and during a simultaneous heating and hot-water supply operation of simultaneously performing the heating operation and the hot-water supply operation. That is, refrigerant having a temperature lower than that of ambient air flows to the heat source-side heat exchanger, and the refrigerant absorbs heat from the ambient air. Therefore, when the heating operation or the simultaneous heating and hot-water supply operation is performed in a low outdoor temperature condition (for example, 6 degrees Celsius or less), frost is formed on the heat source-side heat exchanger. Thus, it is required that the heat source-side heat exchanger be defrosted. In the related-art refrigeration cycle apparatus being capable of performing both the air-conditioning operation and the hot-water supply operation, when the heat source-side heat exchanger is to be defrosted under a state in which the heating operation or the simultaneous heating and hot-water supply operation is performed, a reverse operation of allowing high-temperature refrigerant having been discharged from the compressor to flow into the heat source-side heat exchanger is performed to melt the frost deposited on the heat source-side heat exchanger by heat of the high-temperature refrigerant. Therefore, the related-art refrigeration cycle apparatus being capable of performing both the air-conditioning operation and the hot-water supply operation has a problem in that, when frost is formed on the heat source-side heat exchanger during the heating operation and the simultaneous heating and hot-water supply operation, it is required to stop heating of an indoor space to perform defrosting of the heat source-side heat exchanger.

The present invention has been made to overcome the above-mentioned problem, and has an object to provide a refrigeration cycle apparatus being capable of continuously performing a heating operation and a simultaneous heating and hot-water supply operation without stopping even in an environment under which frost is formed on a heat source-side heat exchanger.

Solution to Problem

According to one embodiment of the present invention, there is provided a refrigeration cycle apparatus including: a water tank; a heat source provided to the water tank and configured to heat water stored in the water tank; and a refrigeration cycle including a compressor, a first heat exchanger, a first expansion valve provided downstream of the first heat exchanger in a refrigerant flow direction, the downstream being in an operation in which the first heat exchanger serves as a condenser, and a second heat exchanger provided to the water tank and configured to exchange heat with the water stored in the water tank, the refrigeration cycle apparatus being configured to execute an operation mode circulating refrigerant through, in order, a discharge outlet of the compressor, the first heat exchanger, the first expansion valve, the second heat exchanger, and a suction inlet of the compressor, and causing the refrigerant flowing through the second heat exchanger to evaporate by heat generated by the heat source.

Advantageous Effects of Invention

The refrigeration cycle apparatus according to one embodiment of the present invention is configured to execute the operation mode circulating the refrigerant through, in order, the discharge outlet of the compressor, the first heat exchanger, the first expansion valve, the second heat exchanger, and the suction inlet of the compressor, and causing the refrigerant flowing through the second heat exchanger to evaporate by heat generated by the heat source. In this operation mode, the first heat exchanger serves as a condenser. Moreover, the second heat exchanger serves as an evaporator. The refrigerant flowing through the second heat exchanger is caused to evaporate by heat of the heat source. In this case, when the amount of heat rejected by the heat source and the amount of heat removed by the second heat exchanger are equal to each other, the temperature of the water in the water tank can be maintained constant. Moreover, when the amount of heat rejected by the heat source is larger than the amount of heat removed by the second heat exchanger, the water in the water tank can be heated by a surplus amount of heat. Thus, the refrigeration cycle apparatus according to the one embodiment of the present invention is capable of continuously performing the heating operation and the simultaneous heating and hot-water supply operation without stopping even in the environment causing formation of frost on the heat source-side heat exchanger.

DESCRIPTION OF EMBODIMENTS

Embodiment 1

Figure 1:
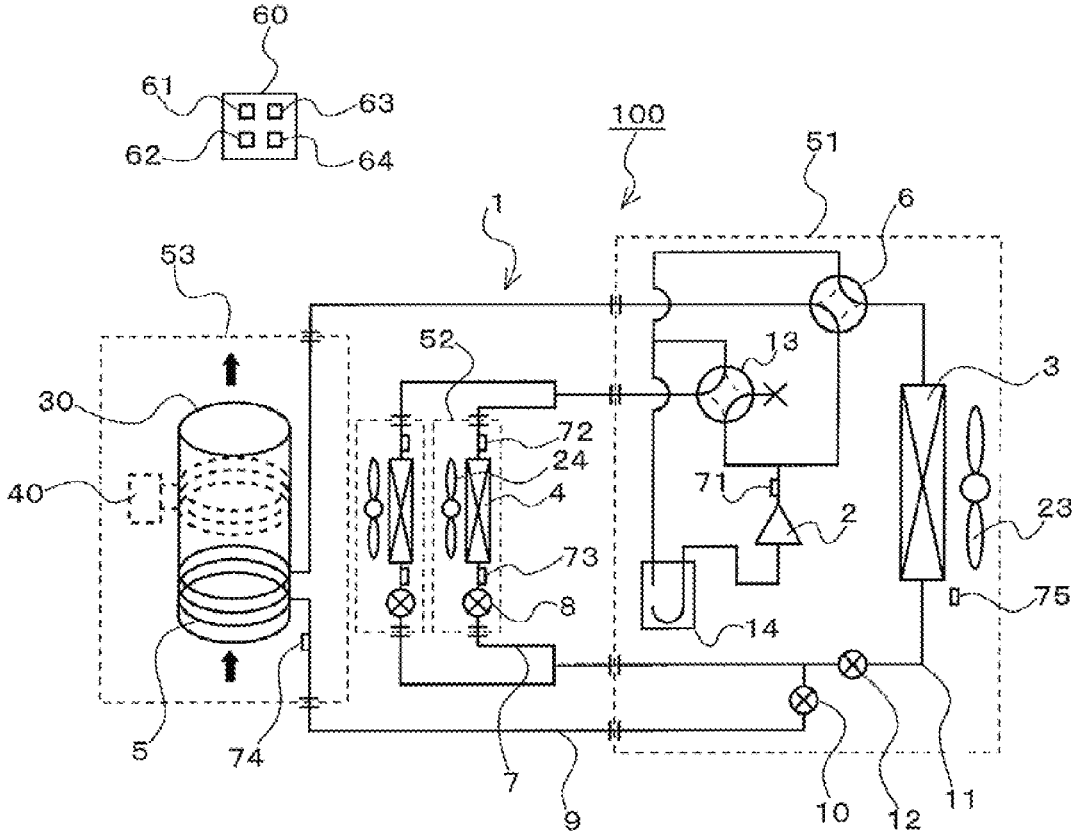
FIG. 1 is a refrigerant circuit diagram for illustrating a refrigeration cycle apparatus according to Embodiment 1 of the present invention.

FIG. 1 is a refrigerant circuit diagram for illustrating a refrigeration cycle apparatus according to Embodiment 1 of the present invention.

A refrigeration cycle apparatus 100 according to Embodiment 1 is capable of performing a heating operation for heating of an indoor space by using an indoor heat exchanger 4 and a hot-water supply operation for heating of water in a water tank 30 by using a water heat exchanger 5. The refrigeration cycle apparatus 100 includes the water tank 30, a heater 40, and a refrigeration cycle 1.

The water tank 30 is configured to store water, for example, city water. In Embodiment 1, water, for example, city water, is supplied to the water tank 30 from a lower portion of the water tank 30 as indicated by the solid arrow in FIG. 1. The water stored in the water tank 30 is heated by at least one of the heater 40 and the water heat exchanger 5 of the refrigeration cycle 1. The water in the water tank 30 having been heated to become hot water flows out of an upper portion of the water tank 30 as indicated by the solid arrow in FIG. 1, and is supplied to a hot-water supply target.

The heater 40 is provided to the water tank 30, and is configured to heat the water stored in the water tank 30. A heat-generating portion of the heater 40 in Embodiment 1 generates heat when power is supplied to the heater 40. The heat-generating portion of the heater 40 is wound around an outer peripheral portion of the water tank 30. That is, when the power is supplied to the heater 40, an outer wall of the water tank 30 is heated by the heat-generating portion, and the water in the water tank 30 is heated through the outer wall. A supply source for supplying power to the heater 40 is not particularly limited. For example, a commercial power supply may be used as the supply source, or a fuel cell may be used as a supply source. Moreover, the heater 40 may be provided in the water tank 30 to directly heat the water in the water tank 30.

The heater 40 corresponds to a heat source in the present invention. The heat source of the present invention is not limited to the heater 40. For example, a gas boiler may be used as the heat source.

The refrigeration cycle 1 includes a compressor 2, a heat source-side heat exchanger 3, indoor heat exchangers 4, the water heat exchanger 5, a flow switching device 6, expansion devices 8, an expansion device 10, and an expansion device 12 as well as pipes connecting those components.

The compressor 2 is configured to suck refrigerant and compress the refrigerant into high-temperature and high-pressure gas refrigerant. The type of the compressor 2 is not particularly limited. For example, a compression mechanism of various types such as a reciprocating type, a rotary type, a scroll type, or a screw type may be used to form the compressor 2. It is preferred that the compressor 2 be of a type capable of variably controlling the rotation number by an inverter.

The flow switching device 6 being, for example, a four-way valve, communicates with a discharge outlet of the compressor 2. The flow switching device 6 is configured to switch between forming a first passage indicated by the broken lines in FIG. 1 and forming a second passage indicated by the solid lines in FIG. 1. The first passage is a passage by which a first inflow/outflow port of the heat source-side heat exchanger 3 and a discharge outlet of the compressor 2 and by which a first inflow/outflow port of the first water heat exchanger 5 and a suction inlet of the compressor 2. The second passage is a passage by which a the first inflow/outflow port of the heat source-side heat exchanger 3 and a suction inlet of the compressor 2 communicate with each other and by which the first inflow/outflow port of the water heat exchanger 5 and the discharge outlet of the compressor 2 communicate with each other. The flow switching device 6 is not limited to the four-way valve, and may be formed of, for example, a combination of a plurality of two-way valves.

The flow switching device 6 corresponds to a first flow switching device in the present invention.

The heat source-side heat exchanger 3 is, for example, an air heat exchanger of a fin-tube type being configured to exchange heat between refrigerant flowing inside thereof and outdoor air. As described above, the first inflow/outflow port of the heat source-side heat exchanger 3 communicates with the flow switching device 6. Moreover, as described later, the second inflow/outflow port of the heat source-side heat exchanger 3 communicates with a pipe 11. In Embodiment 1, to enhance heat exchange between the refrigerant and the outdoor air in the heat source-side heat exchanger 3, a fan 23 configured to supply the outdoor air to the heat source-side heat exchanger 3 is provided in the vicinity of the heat source-side heat exchanger 3.

The heat source-side heat exchanger 3 corresponds to a third heat exchanger in the present invention.

The indoor heat exchanger 4 is, for example, an air heat exchanger of the fin-tube type being configured to exchange heat between refrigerant flowing therein and indoor air. A first inflow/outflow port of the indoor heat exchanger 4 communicates with the discharge outlet of the compressor 2 in parallel with the flow switching device 6. Moreover, a second inflow/outflow port of the indoor heat exchanger 4 communicates with a first end portion of a pipe 7. The expansion device 8 configured to decompress and expand the refrigerant is provided to the pipe 7. In other words, the expansion device 8 is provided downstream of the indoor heat exchanger 4 with respect to refrigerant flow in an operation in which the indoor heat exchanger 4 serves as a condenser. In Embodiment 1, to enhance heat exchange between the refrigerant and the indoor air in the indoor heat exchanger 4, a fan 24 configured to supply the indoor air to the indoor heat exchanger 4 is provided in the vicinity of the indoor heat exchanger 4.

The indoor heat exchanger 4 corresponds to a first heat exchanger in the present invention. The pipe 7 corresponds to a first pipe in the present invention. Moreover, the expansion device 8 corresponds to a first expansion valve in the present invention.

The water heat exchanger 5 is provided to the water tank 30, and is configured to heat the water stored in the water tank 30. The water heat exchanger 5 in Embodiment 1 is formed of, for example, a pipe having a high thermal conductivity, and is wound around the outer peripheral portion of the water tank 30. That is, when refrigerant having a temperature higher than that of the water in the water tank 30 flows through the water heat exchanger 5, the outer wall of the water tank 30 is heated, and the water in the water tank 30 is heated through the outer wall. The water heat exchanger 5 may be provided in the water tank 30 to directly heat the water in the water tank 30. As described above, the first inflow/outflow port of the water heat exchanger 5 communicates with the flow switching device 6. Moreover, the second inflow/outflow port of the water heat exchanger 5 communicates with a first end portion of a pipe 9. An expansion device 10 configured to decompress and expand the refrigerant is provided to the pipe 9.

The water heat exchanger 5 corresponds to a second heat exchanger in the present invention. The pipe 9 corresponds to a second pipe in the present invention. Moreover, the expansion device 10 corresponds to a second expansion valve in the present invention.

A second end portion of the pipe 7 and a second end portion of the pipe 9 communicate with a first end portion of the pipe 11. That is, the pipe 7 and the pipe 9 are connected to the pipe 11 in parallel. A second end portion of the pipe 11 is, as stated above, connected to a second end portion of the heat source-side heat exchanger 3. Moreover, the expansion device 12 is provided to the pipe 11. As described later, the expansion device 12 is used with an opening degree in a fully-opened state or an opening degree in a fully-closed state. Therefore, a valve may be used in place of the expansion device 12.

The pipe 11 corresponds to a third pipe in the present invention. Moreover, the expansion device 12 corresponds to a valve in the present invention.

The refrigeration cycle apparatus 100 according to Embodiment 1 is capable of performing not only the heating operation but also a cooling operation for cooling of an indoor space by using the indoor heat exchanger 4. Therefore, the refrigeration cycle 1 of the refrigeration cycle apparatus 100 includes a flow switching device 13 between the compressor 2 and the first inflow/outflow port of the indoor heat exchanger 4. The flow switching device 13 is configured to switch between forming a third passage indicated by the broken lines in FIG. 1 and a fourth passage indicated by the solid lines in FIG. 1. The third passage is a passage by which the first inflow/outflow port of the indoor heat exchanger 4 and the discharge port of the compressor 2 communicate with each other. The fourth passage is a passage by which the first inflow/outflow port of the indoor heat exchanger 4 and the suction inlet of the compressor 2 communicate with each other. In Embodiment 1, one connection port of the four-way valve is closed to form the flow switching device 13. However, the flow switching device 13 is not limited to the four-way valve, and may be formed of, for example, a combination of a plurality of two-way valves.

The flow switching device 13 corresponds to a second flow switching device in the present invention.

Moreover, in the refrigeration cycle 1 of the refrigeration cycle apparatus 100 according to Embodiment 1, an accumulator 14 configured to store surplus refrigerant is provided at the suction inlet of the compressor 2, specifically, between the suction inlet of the compressor 2 and the flow switching device 6. When the surplus refrigerant is not to be generated, the accumulator 14 may be omitted.

The components of the refrigeration cycle apparatus 100 described above are accommodated in a heat source unit 51, indoor units 52, or a water tank unit 53. Specifically, for example, the heat source unit 51 provided outdoors accommodates the compressor 2, the heat source-side heat exchanger 3, the flow switching device 6, the expansion device 10, the expansion device 12, the flow switching device 13, the accumulator 14, and the fan 23. The indoor units 52 provided in the indoor space each accommodate the indoor heat exchanger 4, the expansion device 8, and the fan 24. The water tank unit 53 accommodates the water tank 30, the water heat exchanger 5, and the heater 40.

In Embodiment 1, two indoor units 52 are connected in parallel. However, in the present invention, the number of the indoor units 52 is not limited to two. Three or more indoor units 52 may be connected in parallel, or only one indoor unit 52 may be provided. Moreover, in Embodiment 1, only one heat source unit 51 and only one water tank unit 53 are provided. However, the number of the heat source unit 51 and the number of the water tank unit 53 are not limited to one. Two or more heat source units 51 may be connected in parallel, and two or more water tank units 53 may be connected in parallel.

Moreover, the refrigeration cycle apparatus 100 includes various sensors and a controller 60 configured to control components of the refrigeration cycle apparatus 100 based on detection values of those sensors.

Specifically, at the discharge outlet of the compressor 2, there is provided a pressure sensor 71 configured to detect a pressure of refrigerant discharged from the compressor 2. Moreover, at a pipe connecting the first inflow/outflow port of the indoor heat exchanger 4 and the flow switching device 13 to each other, there is provided a temperature sensor 72 configured to detect a temperature of refrigerant flowing through the pipe. Moreover, at a position of the pipe 7 that is between the indoor heat exchanger 4 and the expansion device 8, there is provided a temperature sensor 73 configured to detect a temperature of refrigerant flowing through that position. Moreover, at a position of the pipe 9 between the water heat exchanger 5 and the expansion device 10, there is provided a temperature sensor 74 configured to detect a temperature of refrigerant flowing through that position. Moreover, in the vicinity of the heat source-side heat exchanger 3, there is provided a temperature sensor 75 configured to detect a temperature in an installation environment of the heat source-side heat exchanger 3, in other words, a temperature of outdoor air. The temperature sensors 72 to 75 are, for example, thermistors.

The temperature sensor 75 corresponds to a "temperature detection device configured to detect a temperature in an installation environment of the heat source-side heat exchanger" in the present invention.

The controller 60 is constructed by dedicated hardware or a central processing unit (CPU) (which may also be referred to as a processing device, an arithmetic device, a microprocessor, a microcomputer, or a processor) configured to execute a program stored in a memory. The controller 60 is accommodated in, for example, the heat source unit 51.

When the controller 60 is constructed by the dedicated hardware, the controller 60 corresponds to, for example, a single circuit, a composite circuit, an application specific integrated circuit (ASIC), a field-programmable gate array (FPGA), or a combination of those circuits. The respective functional components implemented by the controller 60 may be achieved by individual pieces of hardware, or a single piece of hardware may be used to achieve the functional components.

When the controller 60 is constructed by the CPU, each function executed by the controller 60 is achieved by software, firmware, or a combination of software and firmware. The software or the firmware is described as a program and is stored in a memory. The CPU loads and executes the program stored in the memory, to thereby achieve the respective functions of the controller 60. The memory is, for example, a RAM, a ROM, a flash memory, an EPROM, an EEPROM, or other types of non-volatile or volatile semiconductor memory.

A part of the function of the controller 60 may be achieved by the dedicated hardware, and another part thereof may be achieved by software or firmware.

The controller 60 in Embodiment 1 includes a storage unit 61, a time-measurement unit 62, a calculation unit 63, and a controller 64 as the functional components.

The storage unit 61 is configured to store, for example, values to be used by the controller 64 at the time of controlling a control target and expressions and tables to be used for calculation by the calculation unit 63. Moreover, the storage unit 61 is configured to store initial settings of actuators given at the time of start of the operation modes described later. The time-measurement unit 62 is configured to measure, for example, a drive time period of the compressor 2. The calculation unit 63 is configured to calculate a degree of superheat and a degree of subcooling of refrigerant having flowed out of the indoor heat exchanger 4 and the water heat exchanger 5 based on detection values of the various sensors described above.

The controller 64 is configured to control, in each operation mode described later, switching of the passages by the flow switching devices 6 and 13, opening degrees of the expansion devices 8, 10, and 12, and a heating capacity (input power amount) of the heater 40. Moreover, the controller 64 in Embodiment 1 also controls rotation numbers of the compressor 2 and the fans 23 and 24.

Description of Operations

Next, description is made of operations of the refrigeration cycle apparatus 100 according to Embodiment 1.

The refrigeration cycle apparatus 100 according to Embodiment 1 executes a heating operation mode, a hot-water supply operation mode, a simultaneous heating and hot-water supply operation mode, a cooling operation mode, and a simultaneous cooling and hot-water supply operation mode. Moreover, the refrigeration cycle apparatus 100 according to Embodiment 1 can execute a continuous operation mode to perform the heating operation and the simultaneous heating and hot-water supply operation without stopping even in a low outdoor temperature condition causing formation of frost on the heat source-side heat exchanger 3.

Now, with reference to refrigerant circuit diagrams, description is made of the operation modes.

Heating Operation Mode

Figure 2:
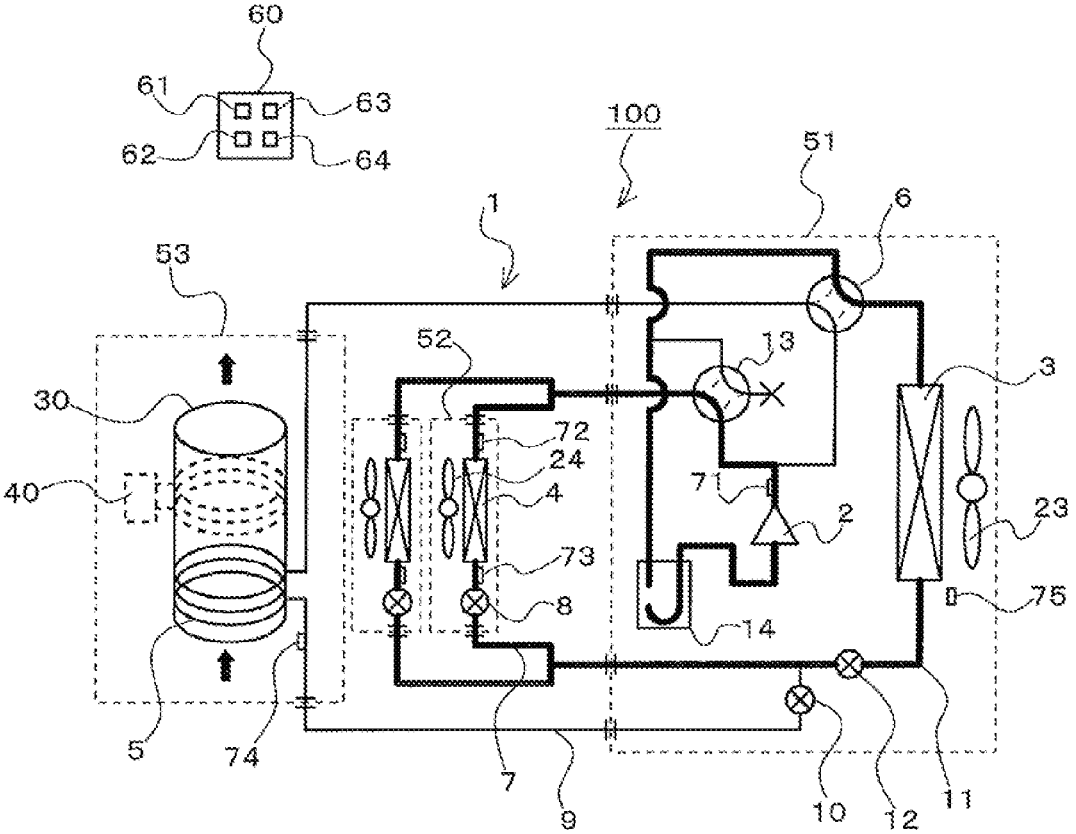
FIG. 2 is a refrigerant circuit diagram for illustrating a heating operation mode of the refrigeration cycle apparatus according to Embodiment 1 of the present invention.

FIG. 2 is a refrigerant circuit diagram for illustrating the heating operation mode of the refrigeration cycle apparatus according to Embodiment 1 of the present invention. In FIG. 2, the pipes illustrated with bold lines are pipes through which refrigerant flows.

The heating operation mode is an operation mode of performing heating of an indoor space by heating indoor air by using the indoor heat exchanger 4. When the heating operation is to be started, the controller 64 controls the flow switching device 6, the flow switching device 13, the expansion devices 8, the expansion device 10, and the expansion device 12 to be in an initial state of the heating operation mode stored in the storage unit 61.

More specifically, the controller 64 switches the passage of the flow switching device 6 so that the flow switching device 6 forms the second passage indicated by the solid lines in FIG. 1. Moreover, the controller 64 switches the passage of the flow switching device 13 so that the flow switching device 13 forms the third passage indicated by the broken lines in FIG. 1. Moreover, the controller 64 sets the opening degree of the expansion device 8 to an initial opening degree of the heating operation mode, for example, to an opening degree of being opened by a preset degree. Moreover, the controller 64 fully-closes the expansion device 10, and fully-opens the expansion device 12. Then, the controller 64 activates the compressor 2 and the fans 23 and 24 to start the heating operation. With this, the indoor heat exchanger 4 serves as a condenser, and the heat source-side heat exchanger 3 serves as an evaporator.

Specifically, high-temperature and high-pressure gas refrigerant having been compressed in the compressor 2 passes through the flow switching device 13 and flows into the indoor heat exchanger 4. Then, the high-temperature and high-pressure gas refrigerant having flowed into the indoor heat exchanger 4 heats the indoor air, that is, heats the indoor space, turns in refrigerant in a liquid state, and flows out of the indoor heat exchanger 4. The refrigerant having flowed out of the indoor heat exchanger 4 flows into the expansion device 8. The liquid refrigerant having flowed into the expansion device 8 is decompressed in the expansion device 8 to be in a low-temperature gas-liquid two-phase state, and flows out of the expansion device 8.

At this time, the controller 64 controls the opening degree of the expansion device 8 so that the degree of subcooling of the refrigerant at an outlet of the indoor heat exchanger 4 is set to a preset value stored in the storage unit 61. The degree of subcooling is calculated by the calculation unit 63. More specifically, the calculation unit 63 calculates a condensing temperature of refrigerant flowing through the indoor heat exchange 4 based on a detection value of the pressure sensor 71, that is, a value of pressure of refrigerant discharged from the compressor 2. Moreover, the calculation unit 63 acquires a detection value of the temperature sensor 73, that is, a temperature of the refrigerant having flowed out of the indoor heat exchanger 4. Then, the calculation unit 63 subtracts the detection value of the temperature sensor 73 from the condensing temperature to calculate the degree of subcooling of the refrigerant at the outlet of the indoor heat exchanger 4. The above-mentioned method of calculating the degree of subcooling is merely an example. For example, a temperature sensor may be provided at a position at which the gas-liquid two-phase refrigerant flows in the indoor heat exchanger 4, and a detection value of the temperature sensor may be used as the condensing temperature.

The low-temperature gas-liquid two-phase refrigerant having flowed out of the expansion device 8 passes through the pipe 7, the pipe 11, and the expansion device 12 and flows into the heat source-side heat exchanger 3. The low-temperature gas-liquid two-phase refrigerant having flowed into the heat source-side heat exchanger 3 absorbs heat from the outdoor air to be evaporated, and thereafter flows out as low-pressure gas refrigerant from the heat source-side heat exchanger 3. The low-pressure gas refrigerant having flowed out of the heat source-side heat exchanger 3 passes through the flow switching device 6 and the accumulator 14 and is sucked into the compressor 2.

Here, refrigerant having a temperature lower than that of ambient air flows in the heat source-side heat exchanger 3 serving as an evaporator so that the refrigerant absorbs heat from the ambient air. Therefore, when the heating operation is performed in a low outdoor temperature condition (for example, at 6 degrees Celsius or less), frost is formed on the heat source-side heat exchanger 3. As the formation of frost on the heat source-side heat exchanger 3 proceeds, the heat absorption capacity of the heat source-side heat exchanger 3 is deteriorated, with the result that the heating operation cannot be performed. Thus, it is required that the heat source-side heat exchanger 3 be defrosted. In such a case, the related-art refrigeration cycle apparatus being capable of performing both the heating operation and the hot-water supply operation is required to temporarily stop the heating operation to perform the defrosting of the heat source-side heat exchanger 3.

In view of this, to perform the defrosting of the heat source-side heat exchanger 3 without stopping the heating operation, the refrigeration cycle apparatus 100 according to Embodiment 1 is switched to the continuous operation mode described below when the defrosting of the heat source-side heat exchanger 3 is to be performed during the heating operation.

Continuous Operation Mode During Heating Operation

Figure 3:
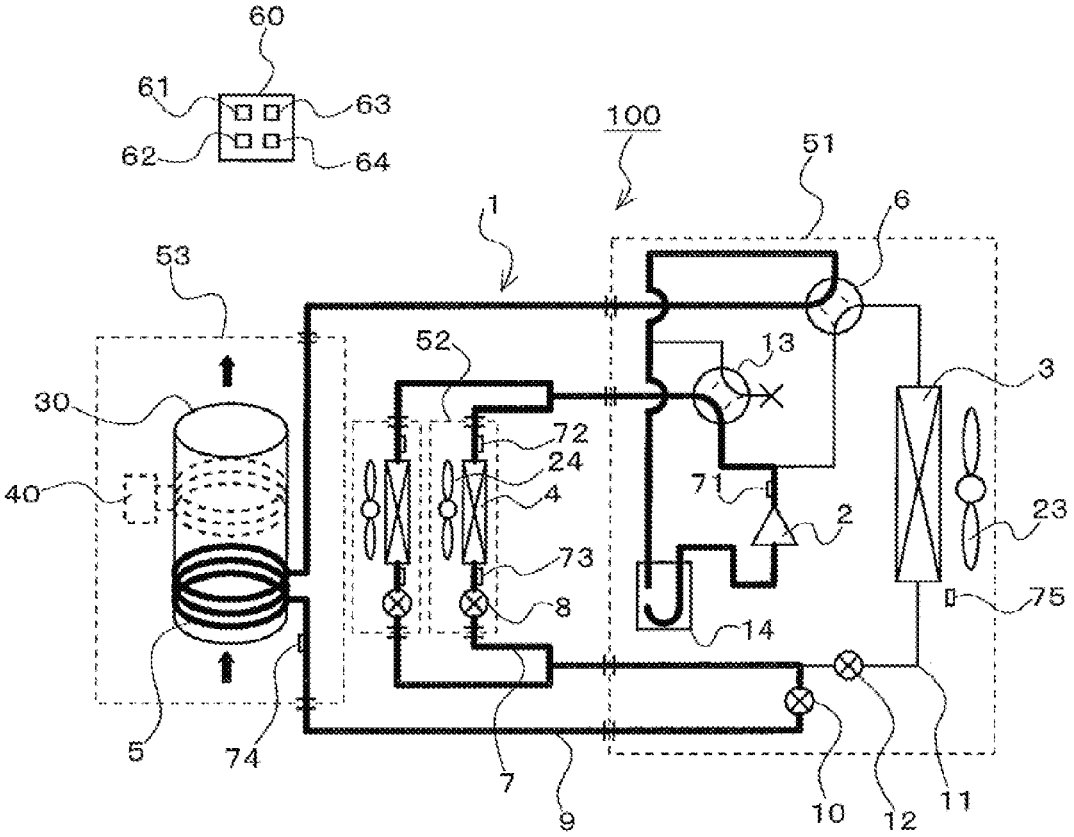
FIG. 3 is a refrigerant circuit diagram for illustrating a continuous operation mode of the refrigeration cycle apparatus according to Embodiment 1 of the present invention.

FIG. 3 is a refrigerant circuit diagram for illustrating the continuous operation mode of the refrigeration cycle apparatus according to Embodiment 1 of the present invention. In FIG. 3, the pipes illustrated with bold lines are pipes through which refrigerant flows.

When it is determined that frost is formed on the heat source-side heat exchanger 3 and that defrosting is necessary, the controller 64 switches the flow switching device 6, the flow switching device 13, the expansion devices 8, the expansion device 10, and the expansion device 12 to the initial state of the continuous operation mode stored in the storage unit 61. Moreover, the controller 64 supplies power to the heater 40.

More specifically, the controller 64 switches the passage of the flow switching device 6 so that the flow switching device 6 forms the first passage indicated by the broken lines in FIG. 1. Moreover, the controller 64 switches the passage of the flow switching device 13 so that the flow switching device 13 forms the third passage indicated by the broken lines in FIG. 1. Moreover, the controller 64 sets the opening degree of the expansion device 8 to an initial opening degree of the continuous operation mode, for example, to an opening degree of being opened by a preset degree. Moreover, the controller 64 fully-opens the expansion device 10, and fully-closes the expansion device 12. Moreover, the controller 64 continues operations of the compressor 2 and the fan 23. With this, the refrigerant circulates through, in order, the discharge outlet of the compressor 2, the indoor heat exchanger 4, the pipe 7, the expansion devices 8, the pipe 9, the expansion device 10, the water heat exchanger 5, and the suction inlet of the compressor 2, and the water heat exchanger 5 serves as an evaporator to cause the refrigerant flowing through the water heat exchanger 5 to evaporate by heat generated by the heater 40.

The determination of whether or not to perform defrosting of the heat source-side heat exchanger 3 is performed, for example, in the following manner. The time-measurement unit 62 acquires a detection value of the temperature sensor 75, that is, a temperature in the installation environment of the heat source-side heat exchanger 3. Then, when the detection value of the temperature sensor 75 is equal to or less than a predetermined temperature (for example, 6 degrees Celsius) stored in the storage unit 61, the time-measurement unit 62 starts measurement of an operation time period of the compressor 2. When the operation time period of the compressor 2 exceeds a preset time period under the state in which the detection value of the temperature sensor 75 is equal to or less than the preset temperature, the controller 64 sets the refrigeration cycle 1 to the continuous operation mode. The preset time period is stored in the storage unit 61.

The continuous operation mode during the heating operation is more specifically described. The high-temperature and high-pressure gas refrigerant having been compressed in the compressor 2 passes through the flow switching device 13 and flows into the indoor heat exchanger 4. Then, the high-temperature and high-pressure gas refrigerant having flowed into the indoor heat exchanger 4 heats the indoor air, that is, heats the indoor space, turns in refrigerant in a liquid state, and flows out of the indoor heat exchanger 4. The refrigerant having flowed out of the indoor heat exchanger 4 flows into the expansion device 8. The liquid refrigerant having flowed into the expansion device 8 is decompressed in the expansion device 8 to have a low-temperature gas-liquid two-phase state, and flows out of the expansion device 8. At this time, the controller 64 controls the opening degree of the expansion device 8 in a manner similar to that during the heating operation.

The low-temperature gas-liquid two-phase refrigerant having flowed out of the expansion device 8 passes through the pipe 7, the pipe 9, and the expansion device 10 and flows into the water heat exchanger 5. In the continuous operation mode, power is supplied to the heater 40. Therefore, heat generated by the heater 40 is transferred to the outer wall of the water tank 30 and the water stored in the water tank 30 and heats the outer wall and the water. Thus, the low-temperature gas-liquid two-phase refrigerant having flowed into the water heat exchanger 5 absorbs heat from the outer wall of the water tank 30 and the water stored in the water tank 30 and is caused to evaporate. That is, the low-temperature gas-liquid two-phase refrigerant having flowed into the water heat exchanger 5 is caused to evaporate by the heat generated by the heater 40. At this time, when the amount of heat rejected by the heater 40 and the amount of heat removed by the water heat exchanger 5 are equal to each other, the temperature of the water in the water tank 30 can be maintained constant. That is, decrease in temperature of the water in the water tank 30 can be prevented.

The refrigerant having evaporated in the water heat exchanger 5 flows out as low-pressure gas refrigerant. The low-pressure gas refrigerant having flowed out of the water heat exchanger 5 passes through the flow switching device 6 and the accumulator 14 and is sucked into the compressor 2.

As described above, in the continuous operation mode, the heating operation can be performed without using the heat source-side heat exchanger 3. Therefore, by switching to the continuous operation mode at the time of defrosting the heat source-side heat exchanger 3, the heating operation can be continuously performed without stopping.

Any method of defrosting the heat source-side heat exchanger 3 may be employed. For example, the defrosting of the heat source-side heat exchanger 3 may be performed by opening the expansion device 12 and allowing the high-temperature refrigerant having been discharged from the compressor 2 to flow to the heat source-side heat exchanger 3. Moreover, for example, the heat source-side heat exchanger 3 may be defrosted by providing a heater to the heat source-side heat exchanger 3 and heating the heat source-side heat exchanger 3 by using the heater. Moreover, for example, when the ambient temperature of the heat source-side heat exchanger 3 is higher than the temperature of frost, the defrosting of the heat source-side heat exchanger 3 may be performed by sending air to the heat source-side heat exchanger 3 by the fan 23. Moreover, in Embodiment 1, after the defrosting of the heat source-side heat exchanger 3 is finished, the controller 64 returns to the heating operation mode described above, that is, to the heating operation mode described with reference to FIG. 2.

Hot-Water Supply Operation Mode

Figure 4:
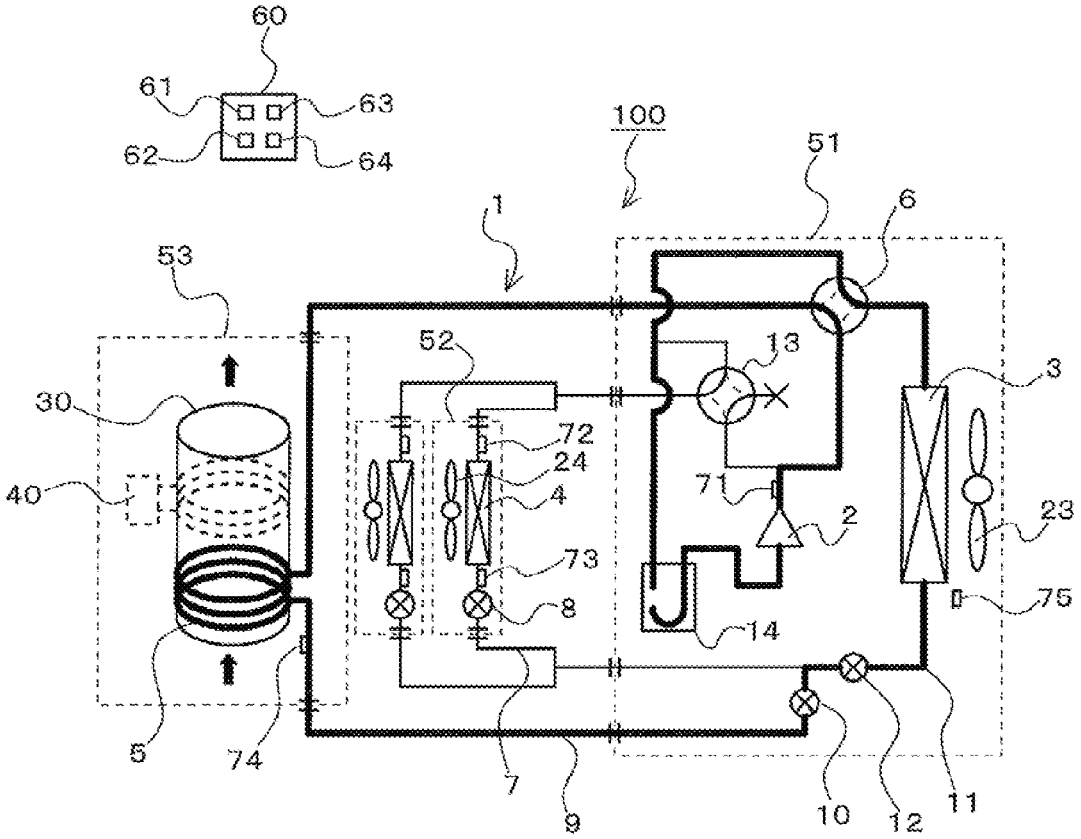
FIG. 4 is a refrigerant circuit diagram for illustrating a hot-water supply operation mode of the refrigeration cycle apparatus according to Embodiment 1 of the present invention.

FIG. 4 is a refrigerant circuit diagram for illustrating the hot-water supply operation mode of the refrigeration cycle apparatus according to Embodiment 1 of the present invention. In FIG. 4, the pipes illustrated with bold lines are pipes through which refrigerant flows.

The hot-water supply operation mode is an operation mode of producing hot water by heating the water stored in the water tank 30 by using the water heat exchanger 5. When the hot-water supply operation is to be started, the controller 64 controls the flow switching device 6, the flow switching device 13, the expansion devices 8, the expansion device 10, and the expansion device 12 to be in an initial state of the hot-water supply operation mode stored in the storage unit 61.

The supply of power to the heater 40 in the hot-water supply operation mode is optional. For example, the water in the water tank 30 may be heated by using only the water heat exchanger 5 without supply of power to the heater 40. Moreover, for example, the water in the water tank 30 may be heated by using both the water heat exchanger 5 and the heater 40 by supplying power to the heater 40.

More specifically, the controller 64 switches the passage of the flow switching device 6 so that the flow switching device 6 forms the second passage indicated by the solid lines in FIG. 1. Moreover, the controller 64 switches the passage of the flow switching device 13 so that the flow switching device 13 forms the fourth passage indicated by the solid lines in FIG. 1. Moreover, the controller 64 sets the opening degree of the expansion device 10 to an initial opening degree of the hot-water supply operation mode, for example, to an opening degree of being opened by a preset degree. Moreover, the controller 64 sets the opening degree of the expansion devices 8 to a fully-closed state, and fully-opens the expansion device 12. Then, the controller 64 activates the compressor 2 and the fans 23 and 24 to start the hot-water supply operation. With this, the water heat exchanger 5 serves as a condenser, and the heat source-side heat exchanger 3 serves as an evaporator.

Specifically, the high-temperature and high-pressure gas refrigerant having been compressed in the compressor 2 passes through the flow switching device 6 and flows into the water heat exchanger 5. Then, the high-temperature and high-pressure gas refrigerant having flowed into the water heat exchanger 5 heats the water stored in the water tank 30, turns in refrigerant in a liquid state, and flows out of the water heat exchanger 5. The refrigerant having flowed out of the water heat exchanger 5 flows into the expansion device 10. The liquid refrigerant having flowed into the expansion device 10 is decompressed in the expansion device 10 to be in a low-temperature gas-liquid two-phase state, and flows out of the expansion device 10.

At this time, the controller 64 controls the opening degree of the expansion device 10 so that the degree of subcooling of the refrigerant at an outlet of the water heat exchanger 5 is of a preset value. The degree of subcooling is calculated by the calculation unit 63. More specifically, the calculation unit 63 calculates a condensing temperature of refrigerant flowing through the water heat exchanger 5 based on a detection value of the pressure sensor 71, that is, a value of pressure of the refrigerant discharged from the compressor 2. Moreover, the calculation unit 63 acquires a detection value of the temperature sensor 74, that is, a temperature of the refrigerant having flowed out of the water heat exchanger 5. Then, the calculation unit 63 subtracts the detection value of the temperature sensor 74 from the condensing temperature to calculate the degree of subcooling of the refrigerant at the outlet of the water heat exchanger 5. The above-mentioned method of calculating the degree of subcooling is merely an example. For example, a temperature sensor may be provided at a position at which the gas-liquid two-phase refrigerant flows in the water heat exchanger 5, and a detection value of the temperature sensor may be used as the condensing temperature.

The low-temperature gas-liquid two-phase refrigerant having flowed out of the expansion device 10 passes through the pipe 9, the pipe 11, and the expansion device 12 and flows into the heat source-side heat exchanger 3. The low-temperature gas-liquid two-phase refrigerant having flowed into the heat source-side heat exchanger 3 absorbs heat from the outdoor air to be evaporated, and thereafter flows out as low-pressure gas refrigerant from the heat source-side heat exchanger 3. The low-pressure gas refrigerant having flowed out of the heat source-side heat exchanger 3 passes through the flow switching device 6 and the accumulator 14 and is sucked into the compressor 2.

Also in the hot-water supply operation, the heat source-side heat exchanger 3 serves as an evaporator. Therefore, when the heating operation is performed in a low outdoor temperature condition (for example, 6 degrees Celsius or less), frost is formed on the heat source-side heat exchanger 3. Therefore, in Embodiment 1, to perform the defrosting of the heat source-side heat exchanger 3 without stopping the hot-water supply operation, when the defrosting of the heat source-side heat exchanger 3 is performed during the hot-water supply operation, the controller 64 supplies power to the heater 40 to heat the water in the water tank 30 by using only the heater 40. As described above, through heating of the water in the water tank 30 by using only the heater 40, the hot-water supply operation can be performed continuously without stopping.

Any method of defrosting the heat source-side heat exchanger 3 may be employed. For example, similarly to the continuous operation mode, the defrosting may be performed by using, for example, the high-temperature refrigerant discharged from the compressor 2, the heater, and the fan 23.

Moreover, in Embodiment 1, after the defrosting of the heat source-side heat exchanger 3 is finished, the controller 64 returns to the hot-water supply operation mode described above, that is, to the heating operation mode described with reference to FIG. 4.

Simultaneous Heating and Hot-Water Supply Operation Mode

Figure 5:
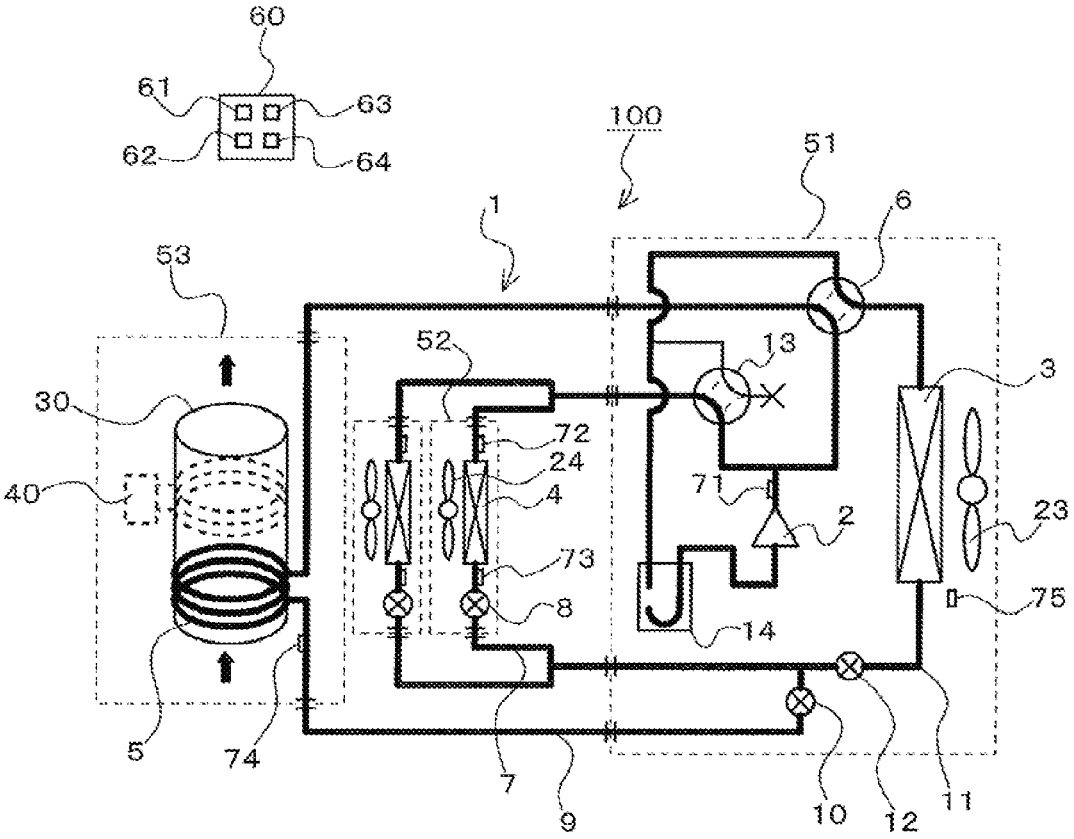
FIG. 5 is a refrigerant circuit diagram for illustrating a simultaneous heating and hot-water supply operation mode of the refrigeration cycle apparatus according to Embodiment 1 of the present invention.

FIG. 5 is a refrigerant circuit diagram for illustrating the simultaneous heating and hot-water supply operation mode of the refrigeration cycle apparatus according to Embodiment 1 of the present invention. In FIG. 5, the pipes illustrated with bold lines are pipes through which refrigerant flows.

The simultaneous heating and hot-water supply operation mode is an operation mode of simultaneously performing the heating operation and the hot-water supply operation. When the simultaneous heating and hot-water supply operation is to be started, the controller 64 controls the flow switching device 6, the flow switching device 13, the expansion devices 8, the expansion device 10, and the expansion device 12 to be in an initial state of the simultaneous heating and hot-water supply operation mode stored in the storage unit 61.

The supply of power to the heater 40 in the simultaneous heating and hot-water supply operation mode is optional. For example, the water in the water tank 30 may be heated by using only the water heat exchanger 5 without supply of power to the heater 40. Moreover, for example, the water in the water tank 30 may be heated by using both the water heat exchanger 5 and the heater 40 by supplying power to the heater 40.

More specifically, the controller 64 switches the passage of the flow switching device 6 so that the flow switching device 6 forms the second passage indicated by the solid lines in FIG. 1. Moreover, the controller 64 switches the passage of the flow switching device 13 so that the flow switching device 13 forms the third passage indicated by the broken lines in FIG. 1. Moreover, the controller 64 controls the opening degree of the expansion device 8 to have the initial opening degree of the simultaneous heating and hot-water supply operation mode, for example, an initial opening degree that is equal to the initial opening degree of the heating operation mode. Moreover, the controller 64 controls the opening degree of the expansion device 10 to have the initial opening degree of the simultaneous heating and hot-water supply operation mode, for example, to an initial opening degree that is equal to the initial opening degree of the hot-water supply operation mode. Moreover, the controller 64 fully-opens the expansion device 12. Then, the controller 64 activates the compressor 2 and the fans 23 and 24 to start the simultaneous heating and hot-water supply operation. With this, the indoor heat exchanger 4 and the water heat exchanger 5 serve as condensers, and the heat source-side heat exchanger 3 serves as an evaporator.

Specifically, part of the high-temperature and high-pressure gas refrigerant having been compressed in the compressor 2 passes through the flow switching device 13 and flows into the indoor heat exchanger 4. Then, the high-temperature and high-pressure gas refrigerant having flowed into the indoor heat exchanger 4 heats the indoor air, that is, heats the indoor space, turns in refrigerant in a liquid state, and flows out of the indoor heat exchanger 4. The refrigerant having flowed out of the indoor heat exchanger 4 flows into the expansion device 8. The liquid refrigerant having flowed into the expansion device 8 is decompressed in the expansion device 8 to be in a low-temperature gas-liquid two-phase state, and flows out of the expansion device 8. At this time, the controller 64 controls the opening degree of the expansion device 8 in a manner similar to that during the heating operation. The low-temperature gas-liquid two-phase refrigerant having flowed out of the expansion device 8 passes through the pipe 7 and flows into the pipe 11.

Meanwhile, the remaining part of the high-temperature and high-pressure gas refrigerant having been compressed in the compressor 2 passes through the flow switching device 6 and flows into the water heat exchanger 5. Then, the high-temperature and high-pressure gas refrigerant having flowed into the water heat exchanger 5 heats the water stored in the water tank 30, turns in refrigerant in a liquid state, and flows out of the water heat exchanger 5. The refrigerant having flowed out of the water heat exchanger 5 flows into the expansion device 10. The liquid refrigerant having flowed into the expansion device 10 is decompressed in the expansion device 10 to be in a low-temperature gas-liquid two-phase state, and flows out of the expansion device 10. At this time, the controller 64 controls the opening degree of the expansion device 10 in a manner similar to that during the hot-water supply operation. The low-temperature gas-liquid two-phase refrigerant having flowed out of the expansion device 10 passes through the pipe 9 and flows into the pipe 11.

The low-temperature gas-liquid two-phase refrigerant having flowed into the pipe 11 passes through the expansion device 12 and flows into the heat source-side heat exchanger 3. The low-temperature gas-liquid two-phase refrigerant having flowed into the heat source-side heat exchanger 3 absorbs heat from the outdoor air to be evaporated, and thereafter flows out as low-pressure gas refrigerant from the heat source-side heat exchanger 3. The low-pressure gas refrigerant having flowed out of the heat source-side heat exchanger 3 passes through the flow switching device 6 and the accumulator 14 and is sucked into the compressor 2.

Also during the simultaneous heating and hot-water supply operation, the heat source-side heat exchanger 3 serves as an evaporator. Therefore, when the simultaneous heating and hot-water supply operation is performed in a low outdoor temperature condition (for example, 6 degrees Celsius or less), frost is formed on the heat source-side heat exchanger 3. Therefore, in Embodiment 1, to perform the defrosting of the heat source-side heat exchanger 3 without stopping the simultaneous heating and hot-water supply operation, when the defrosting of the heat source-side heat exchanger 3 is performed during the simultaneous heating and hot-water supply operation, the mode is switched to the continuous operation mode described below.

Continuous Operation Mode During Simultaneous Heating and Hot-Water Supply Operation The continuous operation mode executed during the simultaneous heating and hot-water supply operation involves an operation that is basically the same as the continuous operation mode executed during the heating operation, that is, the continuous operation mode illustrated in FIG. 3. The continuous operation modes of those are different in amount of power to be supplied to the heater 40.

In the continuous operation mode executed during the simultaneous heating and hot-water supply operation, the controller 64 causes the heater 40 to reject heat by the amount larger than that given in the continuous operation mode executed during the heating operation. The amount of heat rejected by the heater 40 is set larger than the amount of heat removed by the water heat exchanger 5, thereby enabling raising the temperature of the water in the water tank 30 also in the continuous operation mode. That is, the simultaneous heating and hot-water supply operation can be continuously performed without stopping.

Any method of defrosting the heat source-side heat exchanger 3 may be employed. For example, similarly to the continuous operation mode, the heat source-side heat exchanger 3 may be defrosted by using, for example, the high-temperature refrigerant discharged from the compressor 2, the heater, and the fan 23.

Moreover, in Embodiment 1, after the defrosting of the heat source-side heat exchanger 3 is finished, the controller 64 returns to the simultaneous heating and hot-water supply operation mode described above, that is, to the heating operation mode described with reference to FIG. 5.

Cooling Operation Mode

Figure 6:
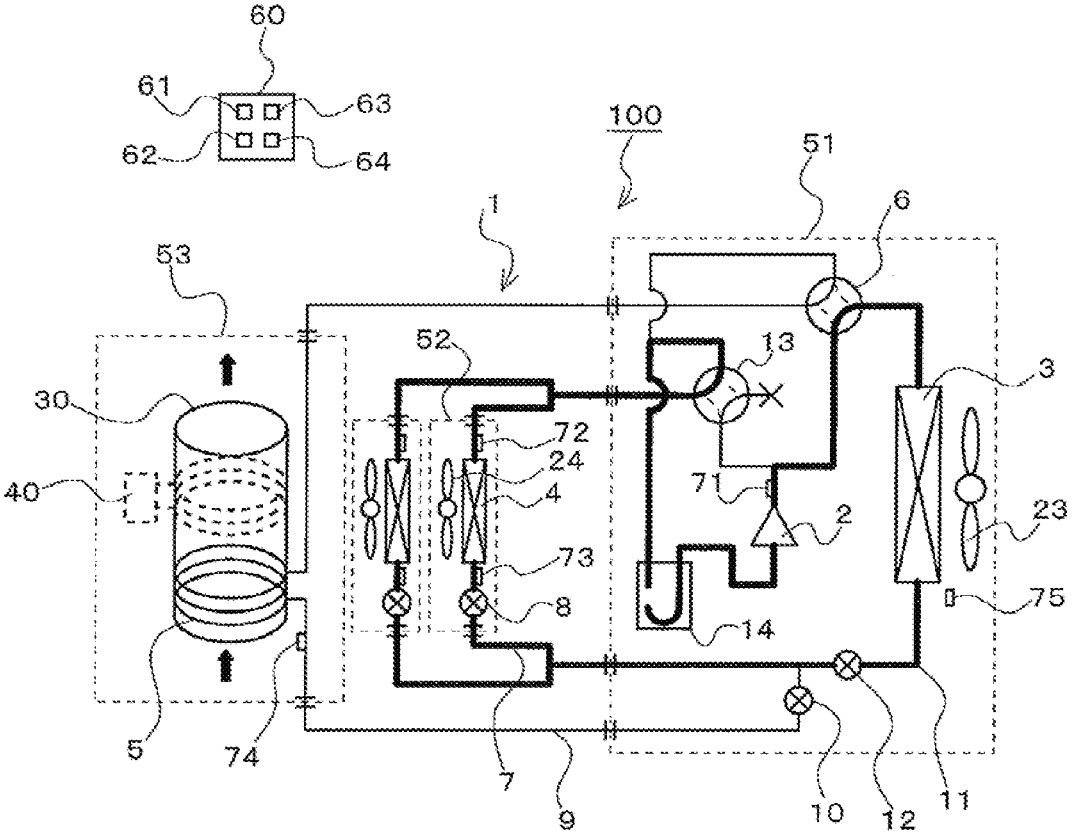
FIG. 6 is a refrigerant circuit diagram for illustrating a cooling operation mode of the refrigeration cycle apparatus according to Embodiment 1 of the present invention.

FIG. 6 is a refrigerant circuit diagram for illustrating the cooling operation mode of the refrigeration cycle apparatus according to Embodiment 1 of the present invention. In FIG. 6, the pipes illustrated with bold lines are pipes through which refrigerant flows.

The cooling operation mode is an operation mode of performing cooling of an indoor space by cooling indoor air by using the indoor heat exchanger 4. When the cooling operation is to be started, the controller 64 controls the flow switching device 6, the flow switching device 13, the expansion devices 8, the expansion device 10, and the expansion device 12 to be in an initial state of the cooling operation mode stored in the storage unit 61.

More specifically, the controller 64 switches the passage of the flow switching device 6 so that the flow switching device 6 forms the first passage indicated by the broken lines in FIG. 1. Moreover, the controller 64 switches the passage of the flow switching device 13 so that the flow switching device 13 forms the fourth passage indicated by the solid lines in FIG. 1. Moreover, the controller 64 controls the expansion device 8 to have an initial opening degree of the cooling operation mode, for example, an opening degree of being opened by a preset degree. Moreover, the controller 64 fully-closes the expansion device 10, and fully-opens the expansion device 12. Then, the controller 64 activates the compressor 2 and the fans 23 and 24 to start the cooling operation. With this, the indoor heat exchanger 4 serves as an evaporator, and the heat source-side heat exchanger 3 serves as a condenser.

Specifically, the high-temperature and high-pressure gas refrigerant having been compressed in the compressor 2 passes through the flow switching device 6 and flows into the heat source-side heat exchanger 3. Then, the high-temperature and high-pressure gas refrigerant having flowed into the heat source-side heat exchanger 3 rejects heat to the outdoor air to be condensed, turns in refrigerant in a liquid state, and flows out of the heat source-side heat exchanger 3. The refrigerant having flowed out of the heat source-side heat exchanger 3 passes through the pipe 11, the expansion device 12, and the pipe 7 and flows into the expansion device 8. The liquid refrigerant having flowed into the expansion device 8 is decompressed in the expansion device 8 to be in a low-temperature gas-liquid two-phase state, and flows out of the expansion device 8.

At this time, the controller 64 controls the opening degree of the expansion device 8 so that the degree of superheat of the refrigerant at an outlet of the indoor heat exchanger 4 is set to a preset value stored in the storage unit 61. The degree of superheat is calculated by the calculation unit 63. More specifically, the calculation unit 63 acquires a detection value of the temperature sensor 73, that is, an evaporation temperature of refrigerant flowing through the indoor heat exchange 4. Moreover, the calculation unit 63 acquires a detection value of the temperature sensor 72, that is, a temperature of the refrigerant having flowed out of the indoor heat exchanger 4. Then, the calculation unit 63 subtracts the detection value of the temperature sensor 73 from the detection value of the temperature sensor 72 to calculate the degree of superheat of the refrigerant at the outlet of the indoor heat exchanger 4. The above-mentioned method of calculating the degree of superheat is merely an example. For example, a pressure sensor may be provided to the suction inlet of the compressor 2, and the evaporation temperature may be calculated based on a detection value of the pressure sensor.

The low-temperature gas-liquid two-phase refrigerant having flowed out of the expansion device 8 flows into the indoor heat exchanger 4. The low-temperature gas-liquid two-phase refrigerant having flowed into the indoor heat exchanger 4 cools the indoor air, that is, cools the indoor space, turns in low-pressure gas refrigerant, and flows out of the indoor heat exchanger 4. The low-pressure gas refrigerant having flowed out of the indoor heat exchanger 4 passes through the flow switching device 13 and the accumulator 14 and is sucked into the compressor 2.

Simultaneous Cooling and Hot-Water Supply Operation Mode

Figure 7:
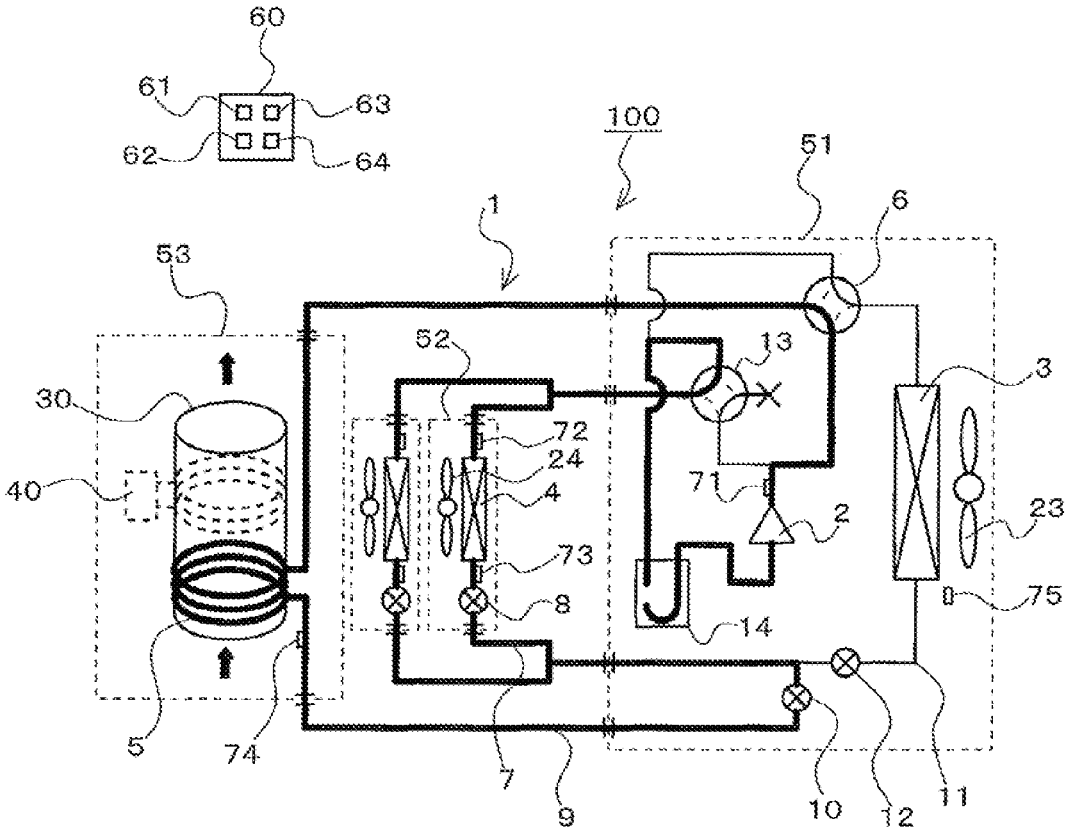
FIG. 7 is a refrigerant circuit diagram for illustrating a simultaneous cooling and hot-water supply operation mode of the refrigeration cycle apparatus according to Embodiment 1 of the present invention.

FIG. 7 is a refrigerant circuit diagram for illustrating the simultaneous cooling and hot-water supply operation mode of the refrigeration cycle apparatus according to Embodiment 1 of the present invention. In FIG. 7, the pipes illustrated with bold lines are pipes through which refrigerant flows.

The simultaneous cooling and hot-water supply operation mode is an operation mode of simultaneously performing the cooling operation and the hot-water supply operation. The simultaneous cooling and hot-water supply operation in Embodiment 1 is an exhaust-heat recovery operation in which heat having been discharged from the heat source-side heat exchanger 3 during the cooling operation is used for heating of the water in the water tank 30 by using the water heat exchanger 5. The heat discharged during the cooling operation can be effectively used, and hence efficiency of the refrigeration cycle apparatus 100 can be improved.

When the simultaneous cooling and hot-water supply operation is to be started, the controller 64 controls the flow switching device 6, the flow switching device 13, the expansion devices 8, the expansion device 10, and the expansion device 12 to be in an initial state of the simultaneous cooling and hot-water supply operation mode stored in the storage unit 61.

The supply of power to the heater 40 in the simultaneous cooling and hot-water supply operation mode is optional. For example, the water in the water tank 30 may be heated by using only the water heat exchanger 5 without supply of power to the heater 40. Moreover, for example, the water in the water tank 30 may be heated by using both the water heat exchanger 5 and the heater 40 by supplying power to the heater 40.

More specifically, the controller 64 switches the passage of the flow switching device 6 so that the flow switching device 6 forms the second passage indicated by the solid lines in FIG. 1. Moreover, the controller 64 switches the passage of the flow switching device 13 so that the flow switching device 13 forms the fourth passage indicated by the solid lines in FIG. 1. Moreover, the controller 64 controls the expansion device 8 to have the initial opening degree of the simultaneous cooling and hot-water supply operation mode, for example, an initial opening degree that is equal to the initial opening degree of the cooling operation mode. Moreover, the controller 64 controls the expansion device 10 to have the initial opening degree of the simultaneous cooling and hot-water supply operation mode, for example, an initial opening degree that is equal to the initial opening degree of the hot-water supply operation mode. Moreover, the controller 64 fully-closes the expansion device 12. Then, the controller 64 activates the compressor 2 and the fans 23 and 24 to start the simultaneous cooling and hot-water supply operation. With this, the water heat exchanger 5 serves as a condenser, and the indoor heat exchanger 4 serves as an evaporator.

Specifically, the high-temperature and high-pressure gas refrigerant having been compressed in the compressor 2 passes through the flow switching device 6 and flows into the water heat exchanger 5. Then, the high-temperature and high-pressure gas refrigerant having flowed into the water heat exchanger 5 heats the water stored in the water tank 30, turns in refrigerant in a liquid state, and flows out of the water heat exchanger 5. The refrigerant having flowed out of the water heat exchanger 5 flows into the expansion device 10. The liquid refrigerant having flowed into the expansion device 10 is decompressed in the expansion device 10 to be in a low-temperature gas-liquid two-phase state, and flows out of the expansion device 10. At this time, the controller 64 controls the opening degree of the expansion device 10 in a manner similar to that during the hot-water supply operation.

The low-temperature gas-liquid two-phase refrigerant having flowed out of the expansion device 10 passes through the pipe 9 and the pipe 7 and flows into the expansion device 8. The liquid refrigerant having flowed into the expansion device 8 is further decompressed in the expansion device 8, and flows out of the expansion device 8. At this time, the controller 64 controls the opening degree of the expansion device 8 in a manner similar to that during the cooling operation. The low-temperature gas-liquid two-phase refrigerant having flowed out of the expansion device 8 flows into the indoor heat exchanger 4. The low-temperature gas-liquid two-phase refrigerant having flowed into the indoor heat exchanger 4 cools the indoor air, that is, cools the indoor space, turns in low-pressure gas refrigerant, and flows out of the indoor heat exchanger 4. The low-pressure gas refrigerant having flowed out of the indoor heat exchanger 4 passes through the flow switching device 13 and the accumulator 14 and is sucked into the compressor 2.

As described above, in the refrigeration cycle apparatus 100 according to Embodiment 1, even in an environment causing formation of frost on the heat source-side heat exchanger 3, the heating operation and the simultaneous heating and hot-water supply operation can be continuously performed without stopping through execution of the above-mentioned continuous operation mode.

Moreover, in the refrigeration cycle apparatus 100 according to Embodiment 1, even in the environment causing formation of frost on the heat source-side heat exchanger 3, the hot-water supply operation can be continuously performed through heating of the water in the water tank 30 by using only the heater 40.

As a method of continuously performing the heating operation without stopping in the environment causing formation of frost on the heat source-side heat exchanger, it is conceivable to employ a method of providing an auxiliary heat source, for example, a heater, in a related-art refrigeration cycle apparatus and heating the indoor space by using the auxiliary heat source during defrosting of the heat source-side heat exchanger 3. However, such a method causes increase in size of the indoor unit. With the refrigeration cycle apparatus 100 according to Embodiment 1, the heating operation can be continuously performed without stopping in the environment causing formation of frost on the heat source-side heat exchanger 3 while the size of the indoor unit 52 is kept compact.

Embodiment 2

A configuration of a refrigeration cycle apparatus 100 according to Embodiment 2 of the present invention is basically the same as that of Embodiment 1. The refrigeration cycle apparatus 100 according to Embodiment 2 is different from that of Embodiment 1 in timing of switching to the continuous operation mode during the heating operation and the simultaneous heating and hot-water supply operation. Moreover, the refrigeration cycle apparatus 100 according to Embodiment 2 is different from that of Embodiment 1 in timing of switching to heating by using only the heater 40 during the hot-water supply operation.

In Embodiment 2, items not described otherwise in particular are similar to those in Embodiment 1, and the same functions and components are denoted by the same reference symbols.

More specifically, in Embodiment 1, the continuous operation mode is executed while the defrosting of the heat source-side heat exchanger 3 is performed during the heating operation. Meanwhile, in the refrigeration cycle apparatus 100 according to Embodiment 2, when the detection value of the temperature sensor 75 is equal to or less than the predetermined temperature (for example, 6 degrees Celsius) stored in the storage unit 61 at the time of starting the heating operation, the heating operation is performed in the continuous operation mode. Moreover, in the refrigeration cycle apparatus 100 according to Embodiment 2, when the detection value of the temperature sensor 75 is equal to or less than the predetermined temperature (for example, 6 degrees Celsius) stored in the storage device 61 during the heating operation, the heating operation is performed in the continuous operation mode. That is, in the refrigeration cycle apparatus 100 according to Embodiment 2, while the installation environment of the heat source-side heat exchanger 3 is in an environment causing formation of frost on the heat source-side heat exchanger 3, the heating operation is performed in the continuous operation mode.

Moreover, in Embodiment 1, the continuous operation mode is executed while the defrosting of the heat source-side heat exchanger 3 is performed during the simultaneous heating and hot-water supply operation. Meanwhile, in the refrigeration cycle apparatus 100 according to Embodiment 2, when the detection value of the temperature sensor 75 is equal to or less than the predetermined temperature (for example, 6 degrees Celsius) stored in the storage unit 61 at the time of starting the simultaneous heating and hot-water supply operation, the simultaneous heating and hot-water supply operation is performed in the continuous operation mode. Moreover, in the refrigeration cycle apparatus 100 according to Embodiment 2, when the detection value of the temperature sensor 75 is equal to or less than the predetermined temperature (for example, 6 degrees Celsius) stored in the storage device 61 during the simultaneous heating and hot-water supply operation, the simultaneous heating and hot-water supply operation is performed in the continuous operation mode. That is, in the refrigeration cycle apparatus 100 according to Embodiment 2, while the installation environment of the heat source-side heat exchanger 3 is in the environment causing formation of frost on the heat source-side heat exchanger 3, the simultaneous heating and hot-water supply operation is performed in the continuous operation mode.

Moreover, in Embodiment 1, while defrosting of the heat source-side heat exchanger 3 is performed during the hot-water supply operation, the water in the water tank 30 is heated by using only the heater 40. Meanwhile, in the refrigeration cycle apparatus 100 according to Embodiment 2, when the detection value of the temperature sensor 75 is equal to or less than the predetermined temperature (for example, 6 degrees Celsius) stored in the storage device 61 at the time of starting the hot-water supply operation, the water in the water tank 30 is heated by using only the heater 40. Moreover, in the refrigeration cycle apparatus 100 according to Embodiment 2, when the detection value of the temperature sensor 75 is equal to or less than the predetermined temperature (for example, 6 degrees Celsius) stored in the storage unit 61 during the hot-water supply operation, the water in the water tank 30 is heated by using only the heater 40. That is, in the refrigeration cycle apparatus 100 according to Embodiment 2, while the installation environment of the heat source-side heat exchanger 3 is in the environment causing formation of frost on the heat source-side heat exchanger 3, the water in the water tank 30 is heated by using only the heater 40.

That is, in the refrigeration cycle apparatus 100 according to Embodiment 2, while the installation environment of the heat source-side heat exchanger 3 is in the environment causing formation of frost on the heat source-side heat exchanger 3, the heat source-side heat exchanger 3 is not used as an evaporator, and frost is prevented from being formed on the heat source-side heat exchanger 3.

As described above, even with the configuration of the refrigeration cycle apparatus 100 according to Embodiment 2, the heating operation, the simultaneous heating and hot-water supply operation, and the hot-water supply operation can be continuously performed without stopping.

Moreover, as compared to Embodiment 1, the refrigeration cycle apparatus 100 according to Embodiment 2 is capable of attaining the following effect.

In Embodiment 1, when the installation environment of the heat source-side heat exchanger 3 is in the environment causing formation of frost on the heat source-side heat exchanger 3, it is required that the flow switching devices 6 and 13 be switched before and after defrosting of the heat source-side heat exchanger 3. Meanwhile, in the refrigeration cycle apparatus 100 according to Embodiment 2, while the installation environment of the heat source-side heat exchanger 3 is in the environment causing formation of frost on the heat source-side heat exchanger 3, the operation in which the heat source-side heat exchanger 3 is not used as an evaporator is continuously performed. Therefore, in the refrigeration cycle apparatus 100 according to Embodiment 2, while the installation environment of the heat source-side heat exchanger 3 is in the environment causing formation of frost on the heat source-side heat exchanger 3, the flow switching devices 6 and 13 are not switched. Therefore, as compared to Embodiment 1, in the refrigeration cycle apparatus 100 according to Embodiment 2, the number of times of switching of the flow switching devices 6 and 13 can be suppressed, and a failure of the flow switching devices 6 and 13 can be suppressed, with the result that reliability of the refrigeration cycle apparatus 100 can be improved.

Meanwhile, as compared to Embodiment 2, the refrigeration cycle apparatus 100 according to Embodiment 1 is capable of attaining the following effect.

When low-temperature refrigerant is to be evaporated during the heating operation and the simultaneous heating and hot-water supply operation, typically, it is more efficient to evaporate the refrigerant by using the heat source-side exchanger 3 serving as an evaporator than to evaporate the refrigerant by using the heat generated by the heater 40. As described above, in the refrigeration cycle apparatus 100 according to Embodiment 2, while the installation environment of the heat source-side heat exchanger 3 is in the environment causing formation of frost on the heat source-side heat exchanger 3, the operation of not using the heat source-side heat exchanger 3 as an evaporator is continuously performed. Meanwhile, in the refrigeration cycle apparatus 100 according to Embodiment 1, while the installation environment of the heat source-side heat exchanger 3 is in the environment causing formation of frost on the heat source-side heat exchanger 3, the heat source-side heat exchanger 3 is used as an evaporator for a period other than the period of defrosting the heat source-side heat exchanger 3. Therefore, as compared to Embodiment 2, the refrigeration cycle apparatus 100 according to Embodiment 1 may be the refrigeration cycle apparatus 100 with higher efficiency.

REFERENCE SIGNS LIST

1 refrigeration cycle 2 compressor 3 heat source-side heat exchanger 4 indoor heat exchanger 5 water heat exchanger 6 flow switching device 7 pipe 8 expansion device 9 pipe 10 expansion device 11 pipe 12 expansion device 13 flow switching device 14 accumulator 23 fan 24 fan 30 water tank 40 heater 51 heat source unit 52 indoor unit 53 water tank unit 60 controller 61 storage unit 62 time-measurement unit 63 calculation unit 64 controller pressure sensor 72 temperature sensor 73 temperature sensor 74 temperature sensor 75 temperature sensor 100 refrigeration cycle apparatus

The invention claimed is:

1. A refrigeration cycle apparatus, comprising: a water tank; a heat source wound around an outer peripheral portion of the water tank and configured to heat water stored in the water tank; a refrigeration cycle including: a compressor, a first heat exchanger, a first expansion valve provided downstream of the first heat exchanger in a refrigerant flow direction, the downstream being in an operation in which the first heat exchanger serves as a condenser, and a second heat exchanger wound around the outer peripheral portion of the water tank and configured to exchange heat with the water stored in the water tank; and a controller configured to execute an operation mode circulating refrigerant through, in order, a discharge outlet of the compressor, the first heat exchanger, the first expansion valve, the second heat exchanger, and a suction inlet of the compressor, and operate the heat source to evaporate the refrigerant flowing through the second heat exchanger by heat generated by the heat source, wherein the heat source is an electric heater or a gas heater.

2. The refrigeration cycle apparatus of claim 1, wherein the refrigeration cycle further includes:

a third heat exchanger;

a first flow switching valve configured to switch a flow passage of refrigerant between:

a first passage, by which the third heat exchanger and the discharge outlet of the compressor communicate with each other and by which the second heat exchanger and the suction inlet of the compressor communicate with each other, and a second passage, by which a refrigerant flow path is formed between the third heat exchanger and the suction inlet of the compressor and by which a refrigerant flow path is formed between the second heat exchanger and the discharge outlet of the compressor;

a first pipe connected to the first heat exchanger, in a middle of which the first expansion valve is provided;

a second pipe connected to the second heat exchanger;

a second expansion valve provided to the second pipe;

a third pipe having a first end portion connected to the first pipe and the second pipe and a second end portion connected to the third heat exchanger; and a valve provided to the third pipe.

3. The refrigeration cycle apparatus of claim 2, further comprising: a temperature sensor configured to detect a temperature in an installation environment of the third heat exchanger, wherein the controller is configured to control the first flow switching valve, the first expansion valve, the second expansion valve, and the valve, and when an operation time period of the compressor exceeds a preset time period under a state in which a detection value of the temperature sensor is equal to or less than a preset temperature, the controller executes the operation mode of the refrigeration cycle.

4. The refrigeration cycle apparatus of claim 2, further comprising:

a temperature sensor configured to detect a temperature in an installation environment of the third heat exchanger, wherein the controller is configured to control the first flow switching valve, the first expansion valve, the second expansion valve, and the valve, and when a detection value of the temperature sensor is equal to or less than a preset temperature, the controller executes the operation mode of the refrigeration cycle.

5. The refrigeration cycle apparatus of claim 1, further comprising a second flow switching valve configured to switch between forming a third passage, by which the first heat exchanger and the discharge outlet of the compressor communicate with each other, and a fourth passage, by which the first heat exchanger and the suction inlet of the compressor communicate with each other.

* * * * *